US008869821B2

(12) United States Patent
Laera

(10) Patent No.: US 8,869,821 B2
(45) Date of Patent: Oct. 28, 2014

(54) EXTENDABLE FAUCET SPOUT

(76) Inventor: Vito Laera, Fort Lauderdale, FL (US)

( * ) Notice: Subject to any disclaimer, the term of this patent is extended or adjusted under 35 U.S.C. 154(b) by 208 days.

(21) Appl. No.: 13/185,701

(22) Filed: Jul. 19, 2011

(65) Prior Publication Data

US 2013/0019974 A1 Jan. 24, 2013

(51) Int. Cl.
*E03C 1/06* (2006.01)
*E03C 1/04* (2006.01)

(52) U.S. Cl.
CPC ..... *E03C 1/0404* (2013.01)
USPC ..... 137/357; 137/355.16; 137/801; 248/75; 239/588; 4/678; 4/695

(58) Field of Classification Search
CPC .... E03C 1/0401; E03C 1/0404; E03C 1/0405
USPC ..... 137/357, 615, 801, 355.16; 239/588, 239/280, 280.5, 281; 4/559, 605, 661, 678, 4/695, 675; 248/75, 80–84
See application file for complete search history.

(56) References Cited

U.S. PATENT DOCUMENTS

| | | | | |
|---|---|---|---|---|
| 192,728 | A | 7/1877 | Bailey | |
| 1,544,706 | A | 7/1925 | Wallen | |
| 1,752,193 | A * | 3/1930 | O'Hanlon | 239/588 |
| 2,133,020 | A | 10/1938 | Fehrenbach | |
| 2,171,875 | A | 9/1939 | Holden | |
| RE21,391 | E | 3/1940 | Holden | |
| RE21,670 | E | 12/1940 | Conklin | |
| 2,276,779 | A | 3/1942 | Isenberg | |
| 2,495,375 | A | 1/1950 | Lishman | |
| 2,853,262 | A | 9/1958 | Reimann | |
| 2,873,999 | A | 2/1959 | Webb | |
| 2,986,364 | A | 5/1961 | Vestal | |
| 3,121,235 | A | 2/1964 | Gellmann | |
| 4,709,715 | A | 12/1987 | Knight | |
| 5,185,893 | A | 2/1993 | Lin | |
| 5,624,074 | A | 4/1997 | Parisi | |
| 5,749,179 | A | 5/1998 | Bohacik | |
| 6,273,138 | B1 | 8/2001 | Yoney | |
| 6,782,568 | B2 | 8/2004 | Novak et al. | |
| 6,820,291 | B1 | 11/2004 | Weaver | |
| 7,344,094 | B1 | 3/2008 | Tracy et al. | |
| 2005/0098658 | A1 | 5/2005 | Burke | |
| 2006/0157128 | A1 | 7/2006 | Frackowiak et al. | |
| 2008/0196160 | A1 * | 8/2008 | Alder et al. | 4/678 |

FOREIGN PATENT DOCUMENTS

| | | | | |
|---|---|---|---|---|
| JP | 2005188172 | A * | 7/2005 | E03C 1/06 |

OTHER PUBLICATIONS

Machine Translation of JP 2005188172.*

* cited by examiner

*Primary Examiner* — Kevin Murphy

(57) ABSTRACT

A pre-rinse assembly including: a base and a vertically disposed riser pipe for conveying water therethrough which has a proximal end and a distal end secured at its proximal end to the base. A hose assembly for conveying water therethrough which has a proximal end and a distal end which may be secured at its proximal end to the distal end of the vertically disposed riser pipe and a spray head assembly for expelling water therethrough may be secured to the distal end of the hose assembly. A telescoping arm assembly having a proximal end which may be pivotally mounted on the vertically disposed riser pipe and a distal end which may be pivotally mounted on the distal end of the hose or the spray head assembly.

20 Claims, 8 Drawing Sheets

EXTENDABLE FAUCET SPOUT

FIELD OF THE INVENTION

The invention relates to faucets and more specifically to pre-rinse faucets used in home or commercial applications.

BACKGROUND OF THE INVENTION

In homes, commercial establishments and institutional establishments, various types of faucets and pre-rinse assemblies have been utilized over the years to rinse food preparation and service implements such as dishes, utensils, pots and pans. The pre-rinse assemblies are generally mounted adjacent to a sink on a wall or a countertop in order to facilitate easy access and use by a dishwasher to manually spray water on the items to be rinsed or cleaned. The vast majority of pre-rinse assemblies employ a spray head which is attached to a flexible hose assembly which conveys water from a riser pipe in order to deliver a spray of water onto the soiled utensils, dishes, pots and pans.

Pre-rinse assemblies do suffer from a major drawback which is the fact that they must be manually directed and held in place by a user onto a specific object or section of a sink. When a dishwasher operates a pre-rinse assembly, he or she simply grabs the spray head, turns on the flow of water, and manually directs the spray of water at the object which is to be rinsed or washed. When the dishwasher has finished using the pre-rinse assembly, they simply let go of the spray head and gravity takes over and returns the spray head to a hanging position below the flexible hose. Some pre-rinse assemblies also include a small hook on or near the riser pipe in order to secure the flexible hose and to keep the spray head out of the way while a sink is used for other activities.

However, none of the pre-rinse assemblies allow a user to manipulate a spray head into a position and then release the spray head and keep it in that position, resulting in a hands-free pre-rinse assembly. Hence, there exists an unsatisfied need for a pre-rinse assembly which may be manipulated into a position and then released while remaining in that position and allowing for hands-free operation of that assembly.

SUMMARY OF THE INVENTION

A pre-rinse assembly comprising: a base and a vertically disposed riser pipe for conveying water therethrough having a proximal end and a distal end secured at its proximal end to the base. A hose assembly for conveying water therethrough having a proximal end and a distal end which may be secured at its proximal end to the distal end of the vertically disposed riser pipe and a spray head assembly for expelling water therethrough may be secured to the distal end of the hose assembly. A telescoping arm assembly having a proximal end which may be pivotally mounted on the vertically disposed riser pipe and a distal end which may be pivotally mounted on the distal end of the hose or the spray head assembly.

BRIEF DESCRIPTION OF THE DRAWINGS

For the purpose of illustrating the invention, there is shown in the figures a form that is presently preferred; it being understood, however, that this invention is not limited to the precise arrangements and instrumentalities shown.

DETAILED DESCRIPTION

Figure 1:
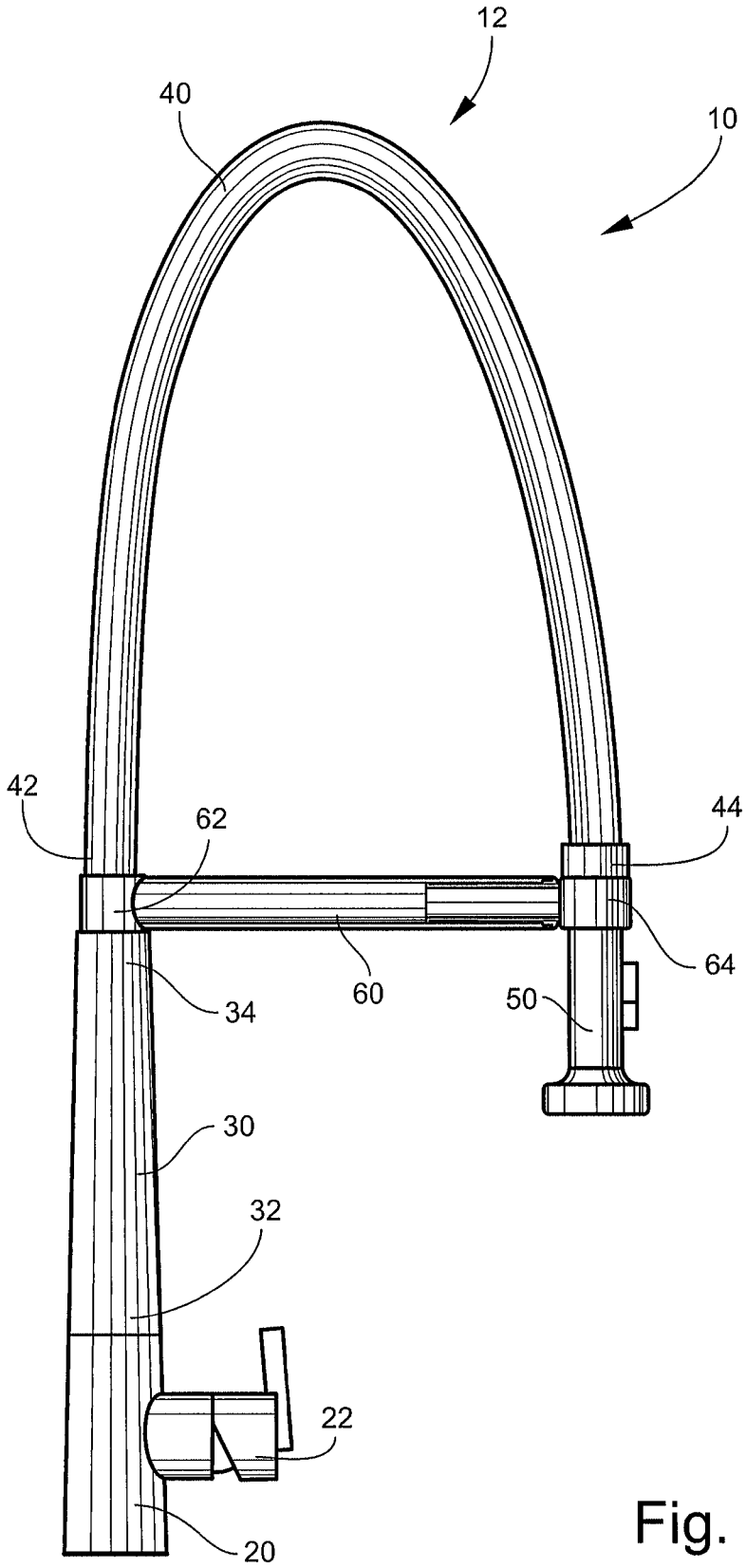
FIG. 1 illustrates a side view of a pre-rinse assembly in a retracted position.

The present invention describes a pre-rinse assembly 10 comprising: a base 20 and a vertically disposed riser pipe 30 for conveying water therethrough having a proximal end 32 and a distal end 34 secured at its proximal end 32 to the base 20. A hose assembly 40 for conveying water therethrough having a proximal end 42 and a distal end 44 which may be secured at its proximal end 42 to the distal end 34 of the vertically disposed riser pipe 30 and a spray head assembly 50 for expelling water therethrough which may be secured to the distal end 44 of the hose assembly 40. A telescoping arm assembly 60 having a proximal end 62 which may be pivotally mounted on the vertically disposed riser pipe 30 and a distal end 64 which may be pivotally mounted on the distal end 44 of the hose assembly 40 or the spray head assembly 50. Looking to FIGS. 1-5 and 9-10 we see illustrated several embodiments of a pre-rinse assembly 10.

Base 20, as used herein, refers to a device from which water may be conveyed. Examples of a base 20 include, but are not limited to, valves, taps, spigots, mixer taps, faucets, and the like. A base 20 may be generally mounted onto a structure for both stability and ease of use. In one embodiment of the present invention, a base 20 may be mounted on a wall 72. In another embodiment, a base 20 may be mounted on a counter top 74. In still another embodiment, a base 20 may be mounted on a sink 75. In yet another embodiment of the present invention, the base 20 may further include one or more handles 22 emanating from the sides of the base 20. The one or more handles 22 may be used to turn the flow of water on or off as well as select the source of the water as being hot, cold, or a combination thereof. A base 20 may be comprised of any material which complies with local plumbing codes and includes, but is not limited to, plastic, copper, brass, zinc, steel, stainless steel, galvanized steel, or a combination thereof.

Countertop 74 (FIGS. 9 and 10), as used herein, refers to a horizontal surface in kitchens, bathrooms, lavatories and workrooms which may be generally installed upon a cabinet. Sink 75, as used herein, refers to a bowl shaped fixture found most often in bathrooms, lavatories and kitchens, but may also be found in places such as laundry rooms, mud rooms and garages. Sinks may be made of a variety of materials and take on a variety of shapes. Materials include, but are not limited to, metals or alloys (stainless steel, cast iron, enameled cast iron, copper, etc.), stone (granite, concrete, marble, soapstone, etc.), ceramic, terrazzo, wood, glass and plastic.

Vertically disposed riser pipe 30, as used herein, refers to a pipe through which water may flow from a suitable base 20. As illustrated in FIGS. 1-5, a vertical riser pipe 30 may be generally secured at its proximal end 32 to a base 20 and may be generally secured at its distal end 34 to a hose assembly 40 and functions to convey water therethrough from the base 20 to the hose assembly 40. A vertically disposed riser pipe 30 may be comprised of any material which complies with local plumbing codes and includes, but is not limited to, plastic, copper, brass, zinc, steel, stainless steel, galvanized steel, or a combination thereof.

Hose assembly 40, as used herein, refers to a hose through which water may flow from a suitable water pipe. As illustrated in FIGS. 1-5 and 9-10, a hose assembly 40 generally may be secured at its proximal end 42 to the distal end 34 of a vertically disposed riser pipe 30 and generally has a spray head assembly 50 secured to the distal end 44 of the hose assembly 40. A hose assembly 40 may be comprised of any material which complies with local plumbing codes and includes, but is not limited to, a flexible hose, a plastic hose, a rubber hose, a nylon hose, a braided plastic hose, a braided stainless steel hose, or a combination thereof. In one embodiment of the present invention, the pre-rinse assembly 10 may further include a spring assembly 45 (see FIG. 5) disposed around the hose assembly 40 to resiliently maintain a portion of the hose assembly 40 in a substantially vertical position. In another embodiment, the pre-rinse assembly 10 may further include a spring assembly 45 disposed around the hose assembly 40 and secured to the vertically disposed riser pipe 30 to resiliently maintain a portion of the hose assembly 40 in a substantially vertical position.

Spring assembly 45 which, as used herein, refers to a coiled spring or the like which may be coiled around the proximal end 42 of a hose assembly 40 so that the spring provides a degree of vertical support to at least a portion of the hose assembly 40 length. (See FIG. 5) Through the use of a spring assembly 45, the distal end 44 of the hose assembly 40 and the spray head assembly 50 hang downwardly to provide easy and comfortable access to the user of the pre-rinse assembly 10 permitting them to direct water from the spray head assembly 50 to any portion of a sink or other nearby object desired. In another embodiment, a spring assembly 45 may refer to an arcuate member which may be described as a spring support device which may be secured to the distal end 34 of a vertically disposed riser pipe 30 and secured to the underside of a hose assembly 40 so that the arcuate member provides a degree of vertical and horizontal support to at least a portion of the hose assembly 40 length. The spring assembly 45 may be made from any material which may be suitable to provide a degree of vertical support to at least a portion of the hose assembly 40 length. Materials may include, but are not limited to, plastic, copper, brass, zinc, steel, stainless steel, galvanized steel, or a combination thereof.

Spray head assembly 50, as used herein, refers to a device which may be secured to the distal end 44 of a hose assembly 40 and may be used for expelling water therethrough into a sink or other container. The spray head assembly 50 may include any type of assembly currently known in the art which may be capable of rinsing food from used dishes, pots, pans, utensils and the like. In one embodiment of the present invention, a spray head assembly 50 may be activated by hand. In another embodiment, a spray head assembly 50 may be activated by a foot pedal.

Figure 6:
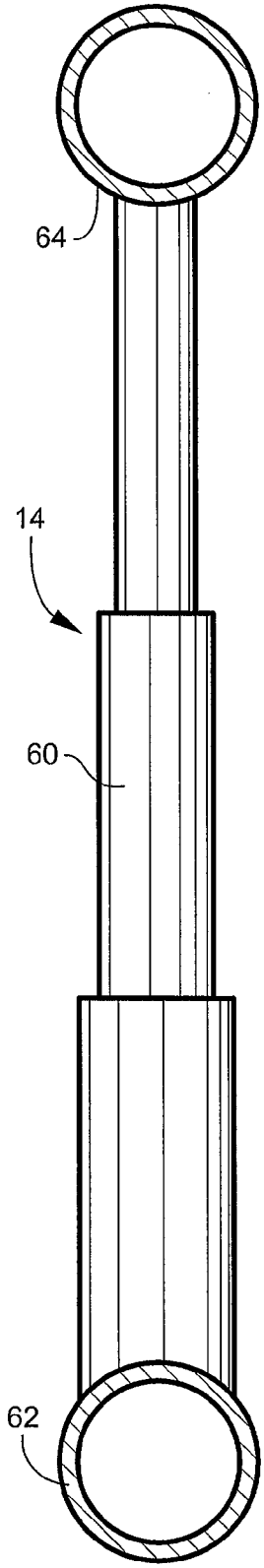
FIG. 6 illustrates a downward view of a telescoping arm assembly.
Figure 7:
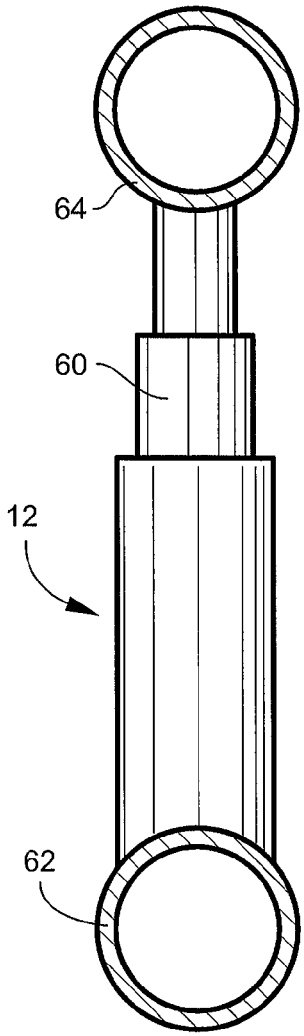
FIG. 7 illustrates a downward view of a telescoping arm assembly.
Figure 8:
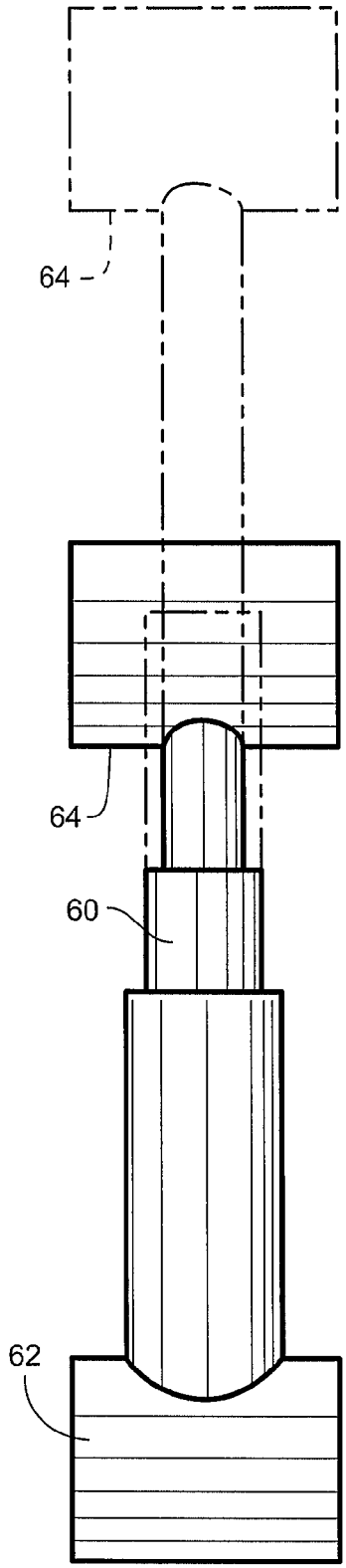
FIG. 8 is a profile view of a telescoping arm assembly

Looking to FIGS. 6, 7 and 8 there is illustrated a telescoping arm assembly 60 which refers to a device with a proximal end 62 and a distal end 64. The telescoping arm assembly 60 may be made of a material selected from the group comprising: plastic, iron, copper, brass, steel, stainless steel, zinc, or a combination thereof. The telescoping arm assembly may have a shape selected from the group comprising: rectangular, square, circular, oval, triangular, diamond, or combinations thereof. As shown in FIGS. 6, 7 and 8 the telescoping arm assembly 60 may be comprised of two or more sections which telescopically engage one another to allow the arm assembly 60 to extend and retract without the sections coming apart. Also shown in FIGS. 6, 7 and 8, the proximal end 62 and the distal end 64 may be formed as hoops which allow for them to be pivotally mounted on a riser pipe, a hose assembly or a spray head assembly 50. In one embodiment of the present invention, the distal end 64 of the telescoping arm assembly 60 may be open (not a hoop) to permit a user to disengage and remove the spray head assembly 50 from the distal end 64 and use it without the aid of the telescopic arm assembly 60, which also allows a user to then re-engage and replace the spray head assembly 50 with the distal end 64 of the telescoping arm assembly 60.

Figure 2:
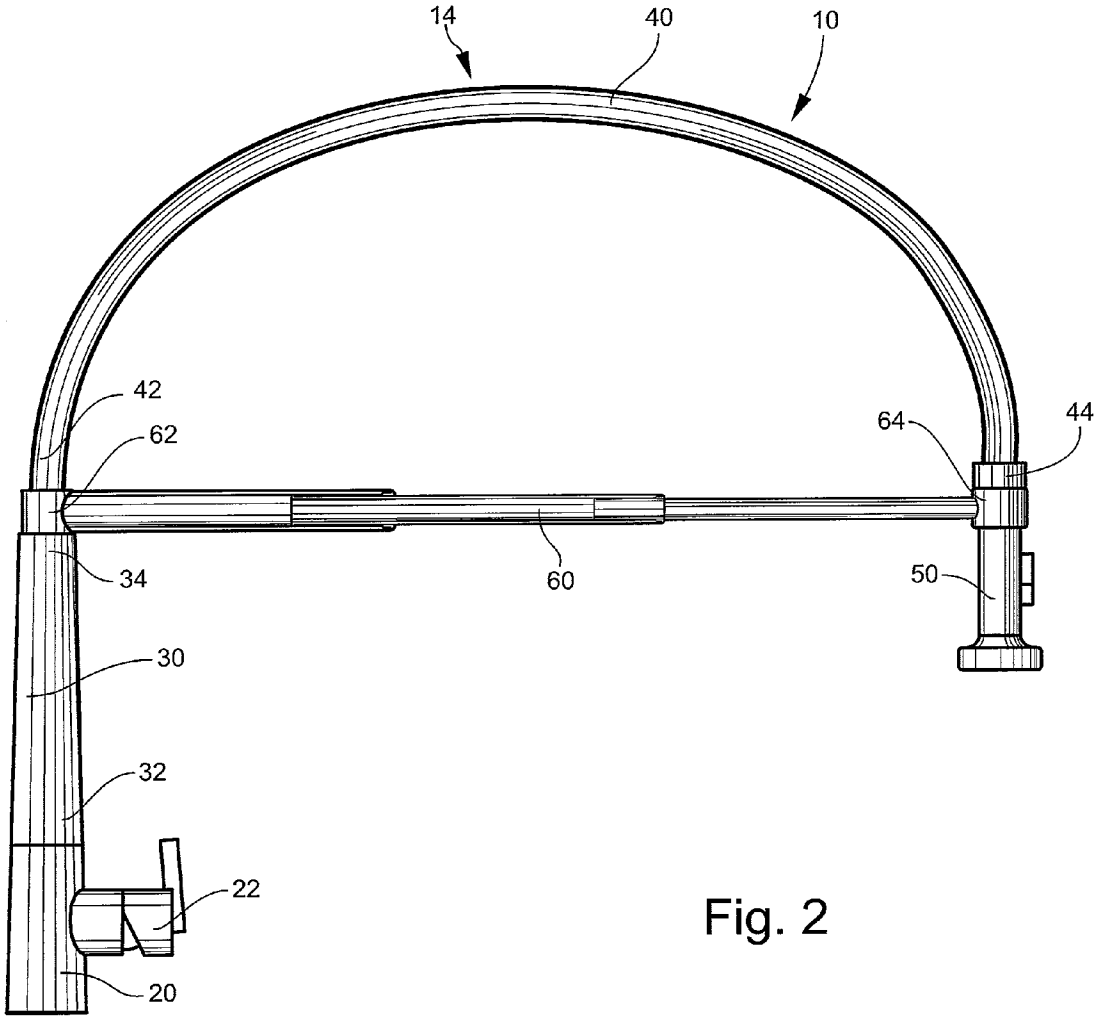
FIG. 2 illustrates a side view of a pre-rinse assembly in an extended position.
Figure 3:
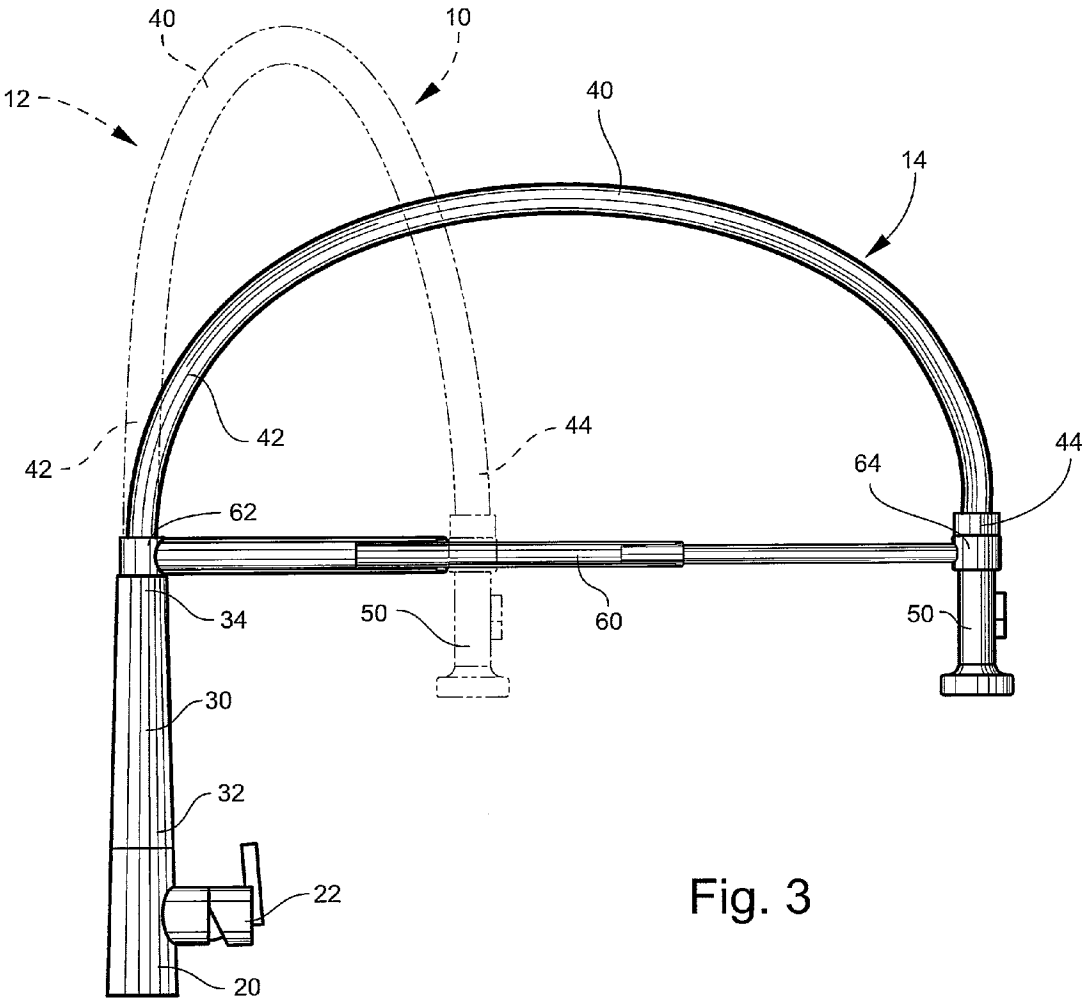
FIG. 3 illustrates a side view of a pre-rinse assembly in both a retracted and an extended position.
Figure 9:
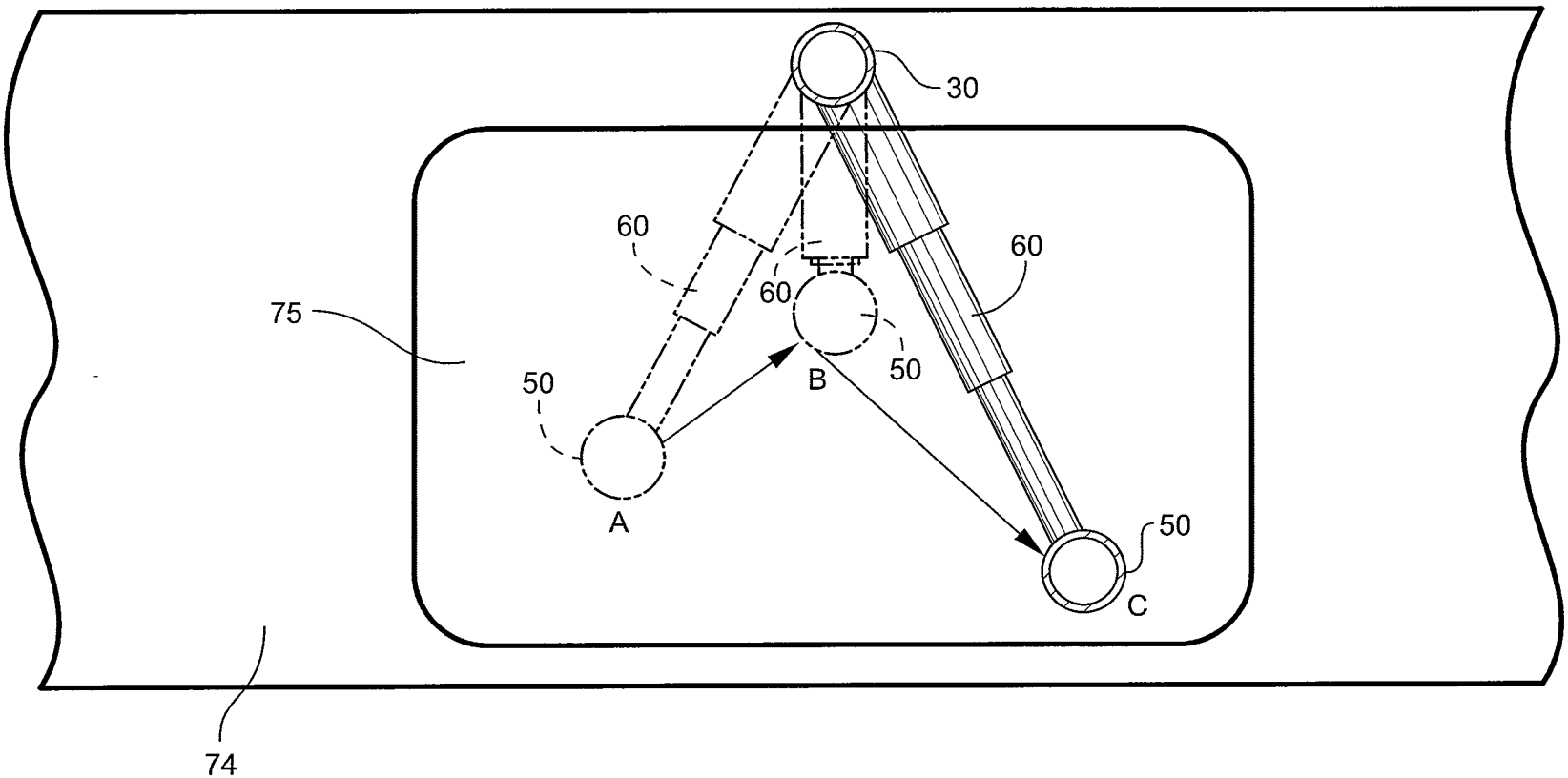
FIG. 9 illustrates a downward view of a telescoping arm assembly in positions A, B, and C over a sink.
Figure 10:
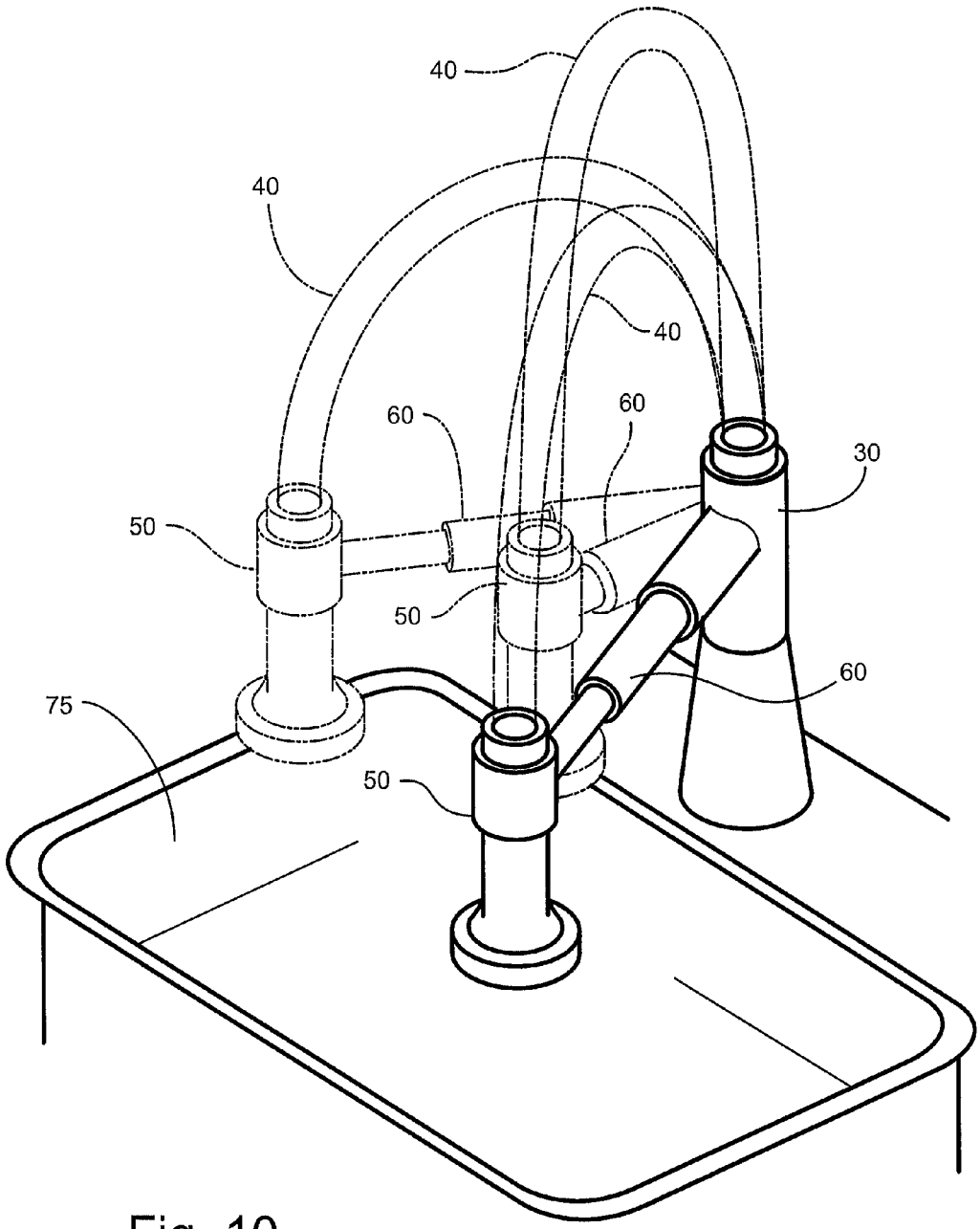
FIG. 10 illustrates a profile view of a telescoping arm assembly in positions A, B, and C over a sink.

Looking to FIG. 2, there is illustrated a telescoping arm assembly 60 which may be compressible or extensible by or as if by the sliding of overlapping sections. FIGS. 1-3 illustrate a telescoping arm assembly 60 with a proximal end 62 which may be pivotally mounted on a vertically disposed riser pipe 30 and a distal end 64 which may be pivotally mounted on the distal end 44 of a hose assembly 40 or a spray head assembly 50. Looking also to FIGS. 3, 9 and 10 we see illustrated that the telescoping arm assembly 60 operates by the movement of one part sliding out from another in order to lengthen the arm assembly 60 and also operates by the movement of one part sliding into another in order to shorten the arm assembly 60. In one embodiment of the present invention, the telescopic arm assembly 60 may be lengthened or shortened to any length permissible by the sliding of two or more overlapping sections without damaging or separating the sections. In another embodiment, the telescopic arm assembly 60 may be lengthened or shortened to any length which permits the spray head assembly 50 to reach and remain at any point within a horizontal plane above a sink 75 adjacent to where the pre-rinse assembly 10 may be mounted (See FIGS. 9 and 10). In another embodiment of the present invention, the telescopic arm assembly 60 may have a retracted length in the range of 10 centimeters to 30 centimeters. In still another embodiment, the telescopic arm assembly 60 may have an extended length in the range of 30 to 90 centimeters. The telescoping arm assembly 60 allows a pre-rinse assembly 10 user to manipulate a spray head assembly 50 into a position and then release the spray head assembly and have it in that position without further manipulation, resulting in a hands-free pre-rinse assembly 10. As illustrated in FIGS. 9 and 10, this may be accomplished by a user moving a spray head assembly 50 from a first position (A) to a second position (B) by compressing the arm assembly 60. The arm assembly 60 will then hold the spray head assembly 50 in position (B) after the user releases his or her grip on the spray head assembly 50. A user may also move the spray head assembly 50 from a second position (B) to a third position (C) by extending the arm assembly 60. Again, the arm assembly will then hold the spray head assembly 50 in position (C) after the user release his or her grip on the spray head assembly and is free to rinse or wash items with both free hands under the water emitted by the spray head.

Figure 4:
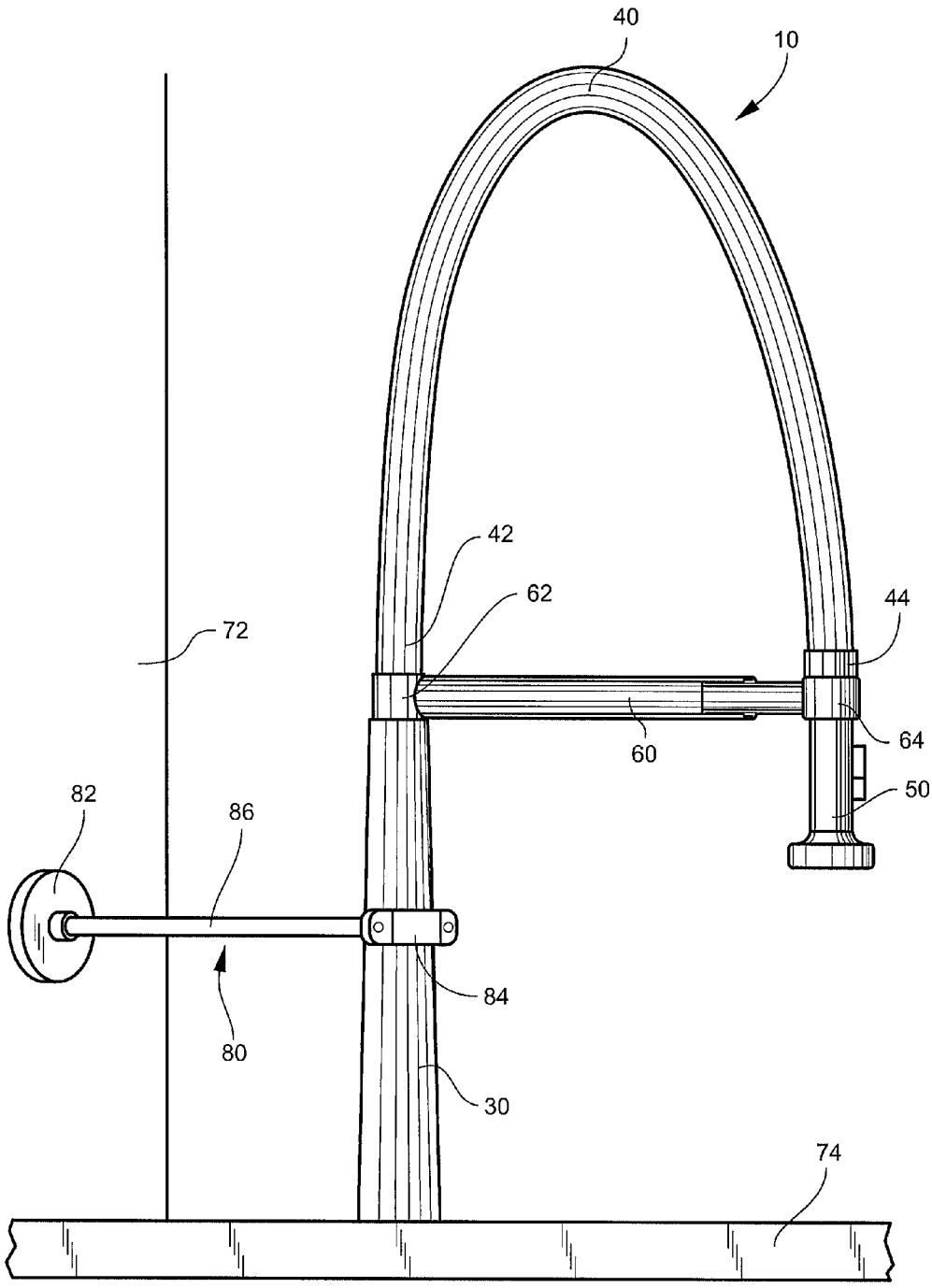
FIG. 4 illustrates a side view of a pre-rinse assembly.
Figure 5:
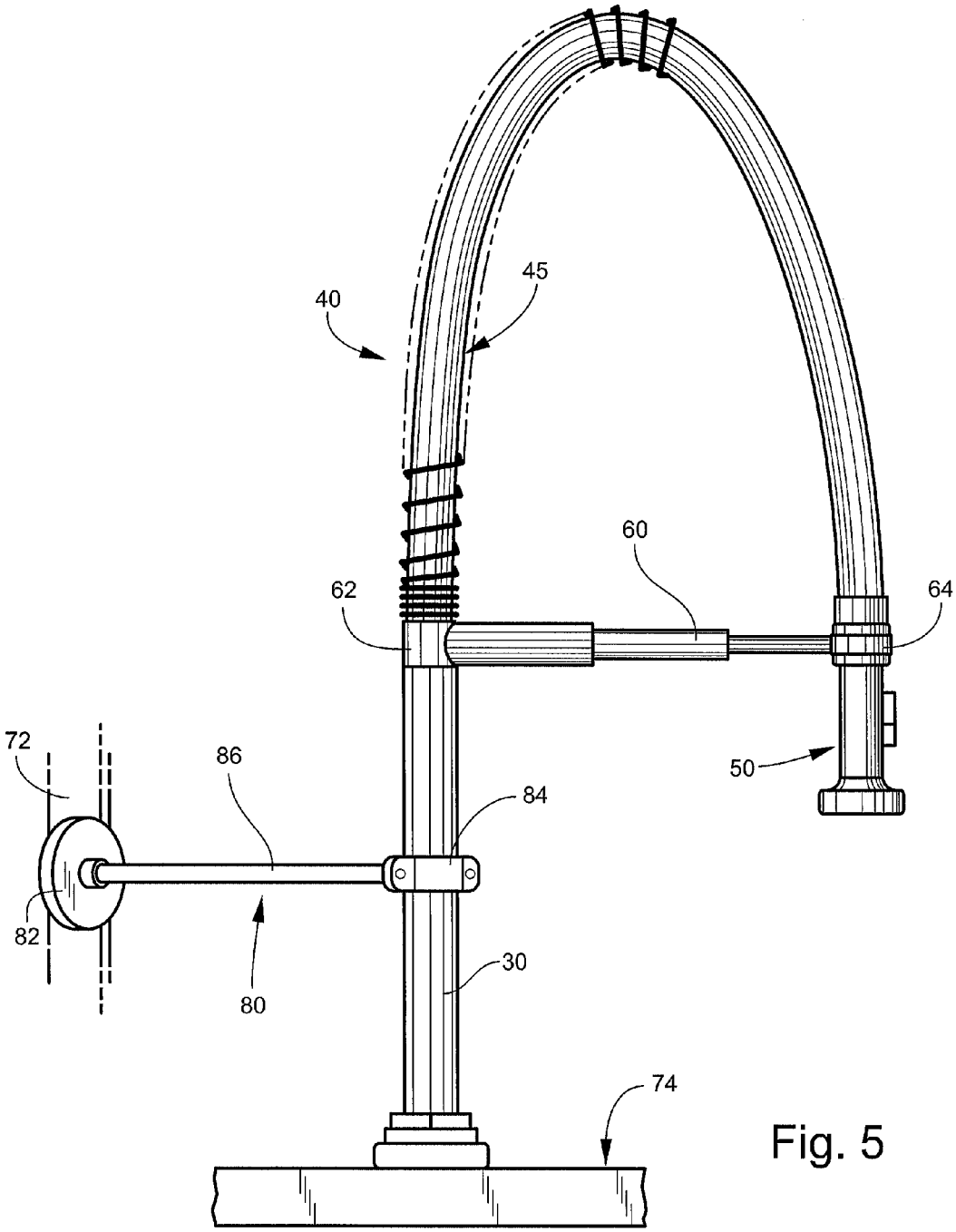
FIG. 5 illustrates a side view of a pre-rinse assembly.

Referring now to FIGS. 4 and 5, a wall bracket assembly 80, as used herein, refers to a device comprising a support member 82 which may be mounted to a wall 72, a clamping means 84 which may be secured to a vertically disposed riser pipe 30, and a rod 86 secured to the support member 82 at one end and secured to the clamping means 84 at its other end. The wall bracket assembly 80 helps to stabilize the vertically disposed riser pipe 30.

One embodiment of the present invention discloses a pre-rinse assembly 10 comprising a base 20 and a vertically disposed riser pipe 30 for conveying water therethrough having a proximal end 32 and a distal end 34 which may be secured at its proximal end 32 to the base 20. A hose assembly 40 for conveying water therethrough having a proximal end 42 and a distal end 44 may be secured at its proximal end 42 to the distal end 34 of the vertically disposed riser pipe 30. A spray head assembly 50 for expelling water therethrough may be secured to the distal end 44 of the hose assembly 40 and a telescoping arm assembly 60 having a proximal end 62 which may be pivotally mounted on the vertically disposed riser pipe 30 and a distal end 64 which may be pivotally mounted on the distal end 44 of the hose assembly 40 or the spray head assembly 50. In one embodiment of the present invention, the base 20 may be mounted on a surface selected from the group comprising: a wall 72, a counter top 74 or a sink 75. In another embodiment of the present invention, the base 20 has one or more handles 22 emanating from the sides of the base 20.

In another embodiment, the pre-rinse assembly described above may further comprise a spring assembly 45 disposed around the hose assembly 40 and secured to the vertically disposed riser pipe 30 to resiliently maintain a portion of the hose assembly 40 in a substantially vertical position. In yet another embodiment, the pre-rinse assembly described above may further comprise an arcuate member secured to the vertically disposed riser pipe 30 and secured to the hose assembly 40. In still another embodiment, the pre-rinse assembly described above may further include a wall bracket assembly 80 comprising a support member 82 which may be mounted to a wall 72, a clamping means 84 which may be secured to the vertically disposed riser pipe 30, and a rod 86 secured to the support member 82 at one end and secured to the clamping means 84 at its other end. In another embodiment of the present invention, the retracted length of the telescoping arm assembly 60 may be in the range of 10 centimeters to 30 centimeters and the extended length of the telescoping arm assembly 60 may be in the range of 30 to 90 centimeters. In still another embodiment of the present invention, the hose assembly 40 may be selected from the group comprising: a plastic hose, a rubber hose, a nylon hose, a braided plastic hose, a braided stainless steel hose, or a combination thereof. In still another embodiment of the present invention, the spray head assembly and/or the hose assembly are removable from the distal end of the telescoping arm assembly. In yet another embodiment, the telescoping arm assembly 60 may be made of a material selected from the group comprising: plastic, iron, copper, brass, steel, stainless steel, zinc, or a combination thereof. In still another embodiment, the telescoping arm assembly 60 has a shape selected from the group comprising: rectangular, square, circular, oval, triangular, diamond, or combinations thereof.

An additional embodiment of the present invention discloses a pre-rinse assembly 10 comprising a base 20, a vertically disposed riser pipe 30 for conveying water therethrough having a proximal end 32 and a distal end 34 which may be secured at its proximal end 32 to the base 20, and a wall bracket assembly 80 comprising a support member 82 which may be mounted to a wall 72, a clamping means 84 which may be secured to the vertically disposed riser pipe 30, and a rod 86 secured to the support member 82 at one end and secured to the clamping means 84 at its other end. The embodiment also includes a hose assembly 40 for conveying water therethrough having a proximal end 42 and a distal end 44 which may be secured at its proximal end 42 to the distal end 34 of the vertically disposed riser pipe 30, a spray head assembly 50 for expelling water therethrough secured to the distal end 44 of the hose assembly 40, a spring assembly 50 disposed around the hose assembly 40 and secured to the vertically disposed riser pipe 30 to resiliently maintain a portion of the hose assembly 40 in a substantially vertical position, and a telescoping arm assembly 60 having a proximal end 62 which may be pivotally mounted on the vertically disposed riser pipe 30 and a distal end 64 which may be pivotally mounted on the distal end 44 of the hose assembly 40 or the spray head assembly 50. In one embodiment of the present invention, the base 20 may be mounted on a surface selected from the group comprising: a wall 72, a counter top 74 or a sink 75. In another embodiment of the present invention, the base 20 has one or more handles 22 emanating from the sides of the base 20.

In another embodiment, the pre-rinse assembly described above may further comprise an arcuate member secured to the vertically disposed riser pipe 30 and secured to the hose assembly 40. In another embodiment of the present invention, the retracted length of the telescoping arm assembly 60 may be in the range of 10 centimeters to 30 centimeters and the extended length of the telescoping arm assembly 60 may be in the range of 30 to 90 centimeters. In still another embodiment of the present invention, the hose assembly 40 may be selected from the group comprising: a plastic hose, a rubber hose, a nylon hose, a braided plastic hose, a braided stainless steel hose, or a combination thereof. In still another embodiment of the present invention, the spray head assembly and/or the hose assembly are removable from the distal end of the telescoping arm assembly. In yet another embodiment, the telescoping arm assembly 60 may be made of a material selected from the group comprising: plastic, iron, copper, brass, steel, stainless steel, zinc, or a combination thereof. In still another embodiment, the telescoping arm assembly 60 has a shape selected from the group comprising: rectangular, square, circular, oval, triangular, diamond, or combinations thereof.

The present invention may be embodied in other forms without departing from the spirit and the essential attributes thereof, and, accordingly, reference should be made to the appended claims, rather than to the forgoing specification, as indicated in the scope of the invention.

The invention claimed is:

1. A pre-rinse assembly comprising:

a base;

a vertically disposed riser pipe for conveying water therethrough having a proximal end and a distal end which may be secured at its proximal end to said base;

a hose assembly for conveying water therethrough having a proximal end and a distal end secured at its proximal end to the distal end of said vertically disposed riser pipe;

a spray head assembly for expelling water therethrough secured to the distal end of said hose assembly, wherein the proximal end of said hose assembly extends vertically upward from said riser pipe, then arching over horizontally and then extending vertically downward at its distal end to engage said spray head and wherein said spray head being substantially vertical and directing said water vertically downward into a sink; and a telescoping arm assembly having a proximal end which is hollow and round and is pivotally mounted around said vertically disposed riser pipe and a distal end which is hollow and round and is pivotally mounted around the distal end of said hose assembly or said spray head assembly which permits the pre-rinse assembly to be used in a hands-free manner.

2. The pre-rinse assembly of claim 1 wherein said base being mounted on a surface selected from the group comprising: a wall, a counter top, a sink.

3. The pre-rinse assembly of claim 1 wherein said base having one or more handles emanating from one or more sides of said base.

4. The pre-rinse assembly of claim 1 further comprising a spring assembly disposed around said hose assembly and secured to said vertically disposed riser pipe to resiliently maintain a portion of said hose assembly in a substantially vertical position.

5. The pre-rinse assembly of claim 4 wherein said spring assembly being an arcuate member secured to said vertically disposed riser pipe and secured to said hose assembly.

6. The pre-rinse assembly of claim 1 further including a wall bracket assembly comprising a support member which may be mounted to a wall, a clamping means which may be secured to said vertically disposed riser pipe, and a rod secured to said support member at one end and secured to said clamping means at its other end.

7. The pre-rinse assembly of claim 1 wherein the retracted length of said telescoping arm assembly being in the range of 10 centimeters to 30 centimeters and the extended length of said telescoping arm assembly being in the range of 30 to 90 centimeters.

8. The pre-rinse assembly of claim 1 wherein the hose assembly is selected from the group consisting of: a plastic hose, a rubber hose, a nylon hose, a braided plastic hose, a braided stainless steel hose, or a combination thereof.

9. The pre-rinse assembly of claim 1 wherein the spray head assembly and/or the hose assembly being removable from the distal end of the telescoping arm assembly.

10. The pre-rinse assembly of claim 1 wherein the telescoping arm assembly being made of a material selected from the group consisting of: plastic, iron, copper, brass, steel, stainless steel, zinc, or a combination thereof.

11. The pre-rinse assembly of claim 1 wherein the telescoping arm assembly having a shape selected from the group consisting of: rectangular, square, circular, oval, triangular, diamond, or combinations thereof.

12. A pre-rinse assembly consisting of:

a base;

a vertically disposed riser pipe for conveying water therethrough having a proximal end and a distal end which may be secured at its proximal end to said base;

a wall bracket assembly comprising a support member which may be mounted to a wall, a clamping means which may be secured to said vertically disposed riser pipe, and a rod secured to said support member at one end and secured to said clamping means at its other end;

a hose assembly for conveying water therethrough having a proximal end and a distal end secured at its proximal end to the distal end of said vertically disposed riser pipe;

a spray head assembly for expelling water therethrough secured to the distal end of said hose assembly, wherein the proximal end of said hose assembly extends vertically upward from said riser pipe, then arching over horizontally and then extending vertically downward at its distal end to engage said spray head and wherein said spray head being substantially vertical and directing said water vertically downward into a sink;

a spring assembly disposed around said hose assembly and secured to said vertically disposed riser pipe to resiliently maintain a portion of said hose assembly in a substantially vertical position; and a telescoping arm assembly having a proximal end which is hollow and round and is pivotally mounted around said vertically disposed riser pipe and a distal end which is hollow and round and is pivotally mounted around the distal end of said hose assembly or said spray head assembly which permits the pre-rinse assembly to be used in a hands-free manner.

13. The pre-rinse assembly of claim 12 wherein said base being mounted on a surface selected from the group comprising: a wall, a counter top, a sink.

14. The pre-rinse assembly of claim 12 wherein said base having one or more handles emanating from one or more sides of said base.

15. The pre-rinse assembly of claim 14 wherein said spring assembly being an arcuate member secured to said vertically disposed riser pipe and secured to said hose assembly.

16. The pre-rinse assembly of claim 12 wherein the retracted length of said telescoping arm assembly being in the range of 10 centimeters to 30 centimeters and the extended length of said telescoping arm assembly being in the range of 30 to 90 centimeters.

17. The pre-rinse assembly of claim 12 wherein the hose assembly is selected from the group consisting of: a plastic hose, a rubber hose, a nylon hose, a braided plastic hose, a braided stainless steel hose, or a combination thereof.

18. The pre-rinse assembly of claim 12 wherein the spray head assembly and/or the hose assembly being removable from the distal end of the telescoping arm assembly.

19. The pre-rinse assembly of claim 12 wherein the telescoping arm assembly being made of a material selected from the group consisting of: plastic, iron, copper, brass, steel, stainless steel, zinc, or a combination thereof.

20. The pre-rinse assembly of claim 12 wherein the telescoping arm assembly having a shape selected from the group consisting of: rectangular, square, circular, oval, triangular, diamond, or combinations thereof.

* * * * *